US006886370B2

(12) United States Patent
Oneda et al.

(10) Patent No.: US 6,886,370 B2
(45) Date of Patent: May 3, 2005

(54) SYSTEM FOR SELECTING THE STITCH FORMING ELEMENTS FOR TEXTILE MACHINES

(75) Inventors: Filippo Oneda, Brescia (IT); Leopoldo Bertagnoli, Turin (IT)

(73) Assignee: Orizio Paolo S.p.A., Brescia (IT)

( * ) Notice: Subject to any disclaimer, the term of this patent is extended or adjusted under 35 U.S.C. 154(b) by 0 days.

(21) Appl. No.: 10/489,392

(22) PCT Filed: Feb. 20, 2002

(86) PCT No.: PCT/EP02/01983

§ 371 (c)(1),
(2), (4) Date: Mar. 11, 2004

(87) PCT Pub. No.: WO03/046268

PCT Pub. Date: Jun. 5, 2003

(65) Prior Publication Data

US 2004/0237601 A1 Dec. 2, 2004

(30) Foreign Application Priority Data

Nov. 26, 2001 (IT) ..... MI2001A2485

(51) Int. Cl.[7] ..... D04B 15/68
(52) U.S. Cl. ..... 66/218
(58) Field of Search ..... 66/215, 216, 218, 66/219, 220, 221

(56) References Cited

U.S. PATENT DOCUMENTS

| | | | | |
|---|---|---|---|---|
| 3,998,073 A | | 12/1976 | Luth | |
| 4,038,837 A | | 8/1977 | Guell | |
| 5,027,619 A | * | 7/1991 | Saito | 66/218 |
| 6,220,062 B1 | * | 4/2001 | Enomoto et al. | 66/218 |
| 6,247,338 B1 | * | 6/2001 | Ganor et al. | 66/218 |
| 6,526,784 B2 | * | 3/2003 | Machida et al. | 66/218 |

FOREIGN PATENT DOCUMENTS

| | | |
|---|---|---|
| GB | 1 456 121 | 11/1976 |
| GB | 2 043 713 | 10/1980 |

* cited by examiner

*Primary Examiner*—Danny Worrell
(74) *Attorney, Agent, or Firm*—Hedman & Costigan, P.C.

(57) ABSTRACT

A system for selecting the stitch forming organs for textile machines; in particular for circular machines for knitwear, contemplates software management such as to update the status of each individual lever (28) of an activator (20), as well as in predetermined time intervals corresponding to the angular positions that occur every K needles (10) or sinkers (26), where K is the number of levers (28) in line of the activator (20), also in other time intervals corresponding to intermediate angular positions includes between 1 and K; the correct value of these angular positions is determined by the profile of the lever (28) of the activator (20).

19 Claims, 13 Drawing Sheets

SYSTEM FOR SELECTING THE STITCH FORMING ELEMENTS FOR TEXTILE MACHINES

The present invention refers to a system for selecting the stitch forming organs for textile machines and, more particularly, for circular machines for knitwear.

In textile machines, such as, in particular, circular machines for knitwear or rectilinear looms, the vertical movements of the needles are selected according to an automatic work procedure the controls of which can be stored in a memory support, so as to create a determined design on the fabric.

To do this, various needle selectors are used for activating their vertical movement.

At present, selecting devices are used which work through the control channels (i.e. technical means realised with cams operating directly on the butt of the needles) and other selecting devices that operate through supplementary mechanisms (jacquard).

In fact, while for the production of simple fabrics (jersey) only one needle control channel is sufficient, to obtain even small patterns two or four or more control channels must be used; interlock type machines are already an example of the need to use two control channels of the needles in each set.

In the case of four-channel selection, the needles have four butt levels, so that one channel corresponds to each level; when a determined needle arrives at a stitch forming system, it will make a stitch, a loop or a tie, depending on whether in the butt corresponding to the channel there is a stitching cam, a looping cam or a cam which holds the needle out of work position (tie).

The knitwork originates from the arrangement of the butts on the needles and from the arrangement of the cams corresponding to the individual machine systems.

Moreover, to have greater freedom in the choice of the knitwork to be made, the selecting butts may be carried by an appendix separate from the needle (jack) and the needle, in turn, presents a butt of its own, used for its lowering.

One of the most classic jacquard selection systems on circular machines for knitwear has a lifting jack, located below each needle and having an intermediate butt, which may be at various levels, for the actual selection, an upper butt for lowering and a lower butt for the lifting control.

At each level of the selecting butts a selecting lever operates, which may be commanded in internal or external position; when it is in external position, all the jacks that have the selecting butt on that level remain in vertical position, so that their lower butt can come up on the control cam and the corresponding needle can be taken into stitching position (selection with two technical ways: work and out of work).

If one of the selecting levers is commanded in internal position, all the jacks that have the selecting butt on that level are sunk into the guide channel, so the lower butt cannot come up on the control cam and the corresponding needle remains out of work.

The pattern therefore originates from the arrangement of the selecting butts of the jacks and from the position assumed by the selecting levers on each level; the arrangement most used is the diagonal arrangement, in which the butts, indicated as TL in FIGS. 1 and 2, are arranged in order, in a regular sequence, so as to form a diagonal, using all the selecting levels, minus 1 (for example, 24 selecting levels, indicated with S, are used in the example shown in FIG. 1 annexed to the present description).

Controlling the selecting butts TL from 1 to 10 and from 20 to 24 towards the inside, the needles from 1 to 10 and from 20 to 24 of each group G, which is composed of 24 needles, do not make a stitch, but the remaining ones do.

Many combinations are therefore formed on the fabric, with a width equal to the number of the selectors TL in operation (24 in the example); the length of the repeat of the pattern will have a minimum value equal to the number of the machine feeding stations, divided by the number of colours, because there is the minimum possibility of making as many knitting courses as are the machine feeding stations, since a set of selecting levers is located in correspondence to each one of them.

Alternatively it is possible to have an arrangement at the tip of the selecting butts TL, according to which the jacks are arranged with their butts in an orderly sequence so as to form two opposing diagonals, as illustrated in FIG. 2 enclosed.

In this case all the selection levels S are used, but in the return half the first and the last level are excluded, so as not to have two adjacent needles performing the same work; the width of the arrangement is thus exactly double that of the diagonal arrangement, facilitating the operations for modifying the arrangement of the jacks.

Supposing that the same selecting levers as in the previous selection (diagonal) have been controlled in an internal position, for each group G1, G2, respectively comprising 25 and 24 needles, the needles from 1 to 10, from 20 to 24, from 26 to 30 and from 40 to 48 will be excluded from work; the pattern is therefore symmetrical and is repeated on the fabric with a width equal to the number of the selecting levers (minus one) and multiplied by 2. The length of the repeat is the same as that of the diagonal arrangement.

To avoid the lift on the cams of the selector, a solution is usually adopted according to which under each needle there is a first jack with only one butt level and, in turn, this jack is under the control of a swinging jack, which brings the selecting butt to one of the many expected levels.

The development of the repeat of the pattern in the lengthwise direction is linked to the possibility of modifying the position of the selecting levers on completion of each revolution of the machine cylinder.

The jacquard selection systems considered until now have limited dimensions of the pattern repeat, however the extension of the repeat to the whole circumference of the machine may be obtained with electronic control systems.

The enclosed FIG. 3 shows a classic electromechanical selection system with electronic control, according to which, under each needle, indicated with 10 and housed inside a first channel 14, adjacent to the cylinder 16 of the circular machine, a jack 11 is working, positioned with the butt inside a second channel 15, the position of which is controlled by a control magnet 12 with the interposition of a spring 13, which substantially acts as a selector-actuator for the electric impulses.

At the precise moment in which the jack 11 with the respective spring 13 passes in front of the magnet 12, the latter can change its status and, if the spring 13 is attracted by the magnet 12, the jack 11 remains engaged in the channel 15 and sets the needle 10 to work; with this respect, it is very important for the arrival of the impulses and the passage of the needles 10 to be synchronised. The selection occurs among two technical ways and the number of the possible patterns become therefore almost unlimited, since with the passage of each needle 10 it is possible to change the energising status of the magnets (one for each feeding station of the machine); the real possibilities depend on the memory capacity of the controlling electronic processor.

At present there are various systems for the electronic control of selection.

On this subject, FIG. 4 shows the operating diagram of an example of embodiment, comprising a processor EP specially programmed by an application programme PA and a reading unit UL, which allows the information concerning the pattern to be loaded in the processor EP.

Thanks to a video terminal TV, the operator controls the processing procedure and can intervene to make modifications; when he thinks that the pattern has been assimilated by the processor in its final form, the information is transmitted to the machine MC and the fabric is produced.

The data concerning the pattern can be recorded on a memory support SM and can also be printed with the printer SP.

More recently, textile machines have been developed, and in particular circular machines for knitwear, in which the needles are selected by guiding and engaging devices (with three technical ways).

In particular, FIGS. 4*a*, 4*b* and 4*c* show schematic and partial views, in cross section, of the needle selection system, according to this last method, in circular machines for knitwear with single and double set of needles.

As is clearly visible in FIG. 4A, the needles 10 and the jacks 10A of the circular machine are housed and may be vertically moved in a plurality of slits 17, provided around the circumference of a rotating cylinder 16 and arranged longitudinally with respect to it and parallel to each other.

Below each needle 10 and jack 10A there is usually a selector 100 with one or more selecting teeth or butts TL, suited for establishing a contact with the levers 21 of the actuator 20A.

If the teeth or butts TL come into contact with the levers 21, the respective selector 100 and its jack 100A are pushed towards the inside of the rotating cylinder 16 and the butt 110 of the jack 10A loses contact with the lift cam, and so the needle 10 does not go up to take thread and remains in out of work position.

The basic principle of operation contemplates that each needle 10 is vertically activated by the jacks 10A, so as to create a loop or make (or not make) each step in the stitch; finally, the pattern of a fabric may be obtained both by controlling the vertical movement of the needles 10 in a suitable way (forming a loop and taking the thread to make the stitch) and allowing the advance of the machine to a subsequent stage of the process (feeding station or feed) without taking the thread (selection with two technical ways: work or out of work). The vertical movement of the needles 10 is controlled by an activating device 20A, which operates on the basis of information coming from a controller, equipped with a memory support and with special selective engagement means between the activating levers 21, the selectors 100 and respective teeth or butts TL and the jacks 10A.

In an example of an embodiment, segments made of piezoelectric material are used as the means for moving the levers 21; these segments assume an arched position following a determined direction, depending on the voltage applied. According to the curve of the piezoelectric segments, the levers 21 assume two positions and condition the rise or non rise of the needles 10, depending on the pattern to be reproduced on the fabric.

In particular, as illustrated more clearly in FIGS. 4D–4H, the actuator 20A normally comprises an outer casing 22 containing a series of elongated elements 130, in piezoelectric material, supported on several points, each of which is forced to bend by the application of an appropriate electric voltage, so as to make the respective lever 21 swing, which is positioned at the end of each elongated element 130 (the movement of the lever 21 is illustrated in detail in FIG. 4F).

In greater detail, a first end of each elongated piezoelectric element 130 is hinged in a removable fashion in a seat 23 of the lever 21, while the opposite end is connected to the control electrodes of the power source.

The lever 21 is supported, in its central part, by a pin that may be housed in the cavity 24, so that, when the piezoelectric element 130 is forced to bend, this motion causes a vertical movement up and down the arm 25 of the lever 21, so as to select the lift of the desired needle 10.

As regards the electronic management of circular knitwear machines of jacquard type, which use a needle selection system by means of actuators such as those described so far, at present software management is provided which reads the pattern to be realised on the fabric as a sequence of bits (an example of this sequence is shown in FIG. 10) and such as to activate the levers 21 of the actuator 20A synchronised with the impulses generated by an encoder mechanically connected to the rotating cylinder 16 and therefore corresponding to its instantaneous angular position.

In particular, this activation comes about in the following manner.

Given the sequence of bits (corresponding to the pattern) to be activated for a general feeding station N, starting from a needle in an equally general position M, and the needles being selectable by means of the levers 21, which, as said above, correspond to a selector 100 with a butt TL in a different position from needle M and needle M+1 to needle M+K, a diagonal of K butts is usually made (as illustrated in FIG. 1) in which K is a number equal to the number of levers 21 of the actuator 20A.

Following the example according to which, corresponding to the needle M there is a jack TL in a conventional initial first position (position indicated with 1 in FIG. 1) and assuming, still conventionally, K=8, the information in bits of the pattern to be realised, with respect to the position of the butts TL indicated with 1, is processed by the software management program in such a way as to activate the first lever 21 of the actuator 20A with sufficient advance (however less than the time corresponding to the passage of K=8 needles) to have the aforesaid first lever 21 of the actuator 20A intercepted with the butt TL of the needle M (case in which the bit for position 1 equals 0, as in the example illustrated in FIG. 10).

Consequently, the bit in position 2 of the pattern (see again FIG. 4R), which has value 1, is processed so that the second lever of the actuator does not intercept the butt of the needle M+1 (on this point, note that the correspondence between the value of the bit of the pattern and the impact or otherwise of the lever 21 with the butt TL is of course purely conventional).

Again, the levers in positions 3–8 of the actuator 20A are activated according to the value of the bits of the pattern present in the respective positions 3–8 for the butts TL of the needles envisaged in the corresponding positions M+2–M+7.

The instant of activation of the levers 21 is synchronised with the rotation of the cylinder 16 and, therefore, the lever in position 2 is activated when the cylinder 16 has performed an angular shift corresponding to one needle (and so on for the levers arranged in positions 3–7); so the status of the lever in position 1 is updated again by the management software when the cylinder 16 has performed a rotation of 8 needles, so as to realise the selection indicated in the pattern with the bit in position 9 and, therefore, to select the needle M+8.

In practice, the control software of jacquard machines with lever actuators update the same lever of the actuator every K needles, K being the number of levers in line of the actuator.

That is, the management software of the prior art updates, at each movement of the rotating cylinder corresponding to a shift made between one needle and the next, the status of one and only one lever of the actuator.

An exception to the above statement may be made in cases of temporary activation of several levers in order to make a cleaning cycle or running-in of the actuator, or the management of the advanced activation of the levers, a parameter which is variable with the speed of the cylinder.

In this case the condition may be created, in the acceleration phase of the rotating cylinder, in which two levers simultaneously update their status, as a variation has been made in the advance phase of lever activation, calculated in real time according to the cylinder speed.

Moreover, in the case where a circular knitwear machine with three or more technical ways is being used (for example, see FIGS. 4L, 4N, 4P and 4Q), the actuator 20B for selecting the needles or the sinkers normally has a first series of levers 21A for determining the working or non working condition of each needle in the portion or group of needles considered G, G1, G2 (in the case considered up till now, each of these groups G, G1, G2 has a number of needles K=8) and a second series of levers 21B, suited to be controlled according to the job to be done, for example causing the needle to take a further thread without clearing the previous stitch (tuck stitch position, third technical way).

The fact that independent controls are used for the operation of these first and second series of levers 21A, 21B, for each needle in the considered group G, G1, G2, presents numerous inconveniences, the principal one of which concerns the fact that for each lever there is a corresponding ceramic element, which makes up the actuator and which must be driven and fed.

Consequently, to realise the third technical way., it is necessary to contemplate doubling the actuators (levers, ceramic elements and feeders) and the controls, with the resulting installation costs, realisation times and reduced reliability so as to guarantee the double selection, for each needle and at each feeding station, necessary for the operation of the machine with three technical ways (for producing jacquard weaves and fabrics or jacquard terry).

Lastly, the traditional optional managements concerning the cleaning cycles or running-in of the actuator, according to which two levers can simultaneously update their status, are to be considered in the present state of the art decidedly auxiliary and do not modify the substance of the previous statements.

The aim of the present invention is therefore to indicate a system for selecting the stitch forming elements for textile machines, in particular for circular or rectilinear machines for knitwear, which overcomes the above-mentioned inconveniences and, in particular, which allows the updating of one or more levers of the actuator at each movement of the rotating cylinder or carriage equal to the distance present between one needle and the next, so as to select and give the desired command to the suitable needles, depending on the information contained in the pattern to be reproduced on the fabric.

Another aim of the present invention is to realise a system for selecting the stitch forming elements for textile machines, in particular for circular or rectilinear machines for knitwear, which allows the realisation of two or more successive commands for each selecting butt corresponding to each needle or sinker, so as to obtain an obvious saving in the number of actuators used.

Another aim of the present invention is to realise a system for selecting the stitch forming elements for textile machines, in particular for circular at low costs by virtue of the advantages achieved and without the use of particularly complex technologies, the whole in a substantially short work time, so as to increase productivity, with respect to the prior art.

These and other aims are achieved by a system for selecting a system for selecting the stitch forming elements for textile machines, in particular for circular machines for knitwear, according to claim 1, to which reference is made for brevity's sake.

Further distinctive technical characteristics form the object of the subsequent claims.

In the course of the discussion, reference will be made, for simplicity's sake, to a circular machine for knitwear with several technical ways, able to work fabrics with different consistencies and equipped with a series of feeding stations for the yarn and the stubbing or top or card sliver.

In any case, it is stressed that the system according to the invention can be applied and used without distinction for other types of textile machines, such as rectilinear machines, stocking machines or machines for making jacquard fabrics or jacquard terry with long and short loops or without loops or with loops on the front and on the back (where the loops on the back can be selected to obtain jacquard effects).

The circular machine for knitwear comprises a framework which supports a rotating cylinder equipped with a series of needles; the needles are forced to rotate together with the cylinder and are free to move vertically, that is in the direction parallel to the axis of rotation of the cylinder.

The machine may be equipped with a series of feeding stations for the thread or for the thread plus card sliver or top, which are equally distant one from the other, in a radial direction, along the circumference of the cylinder provided with needles; each station is positioned in such a way as to feed the suitable yarn and/or fibres to the needles during their rotation with the cylinder.

In practice, the feeding stations are separated from each other by a constant angular spacing and each station comprises, respectively, the feeding device of the yarn and a conventional card for the feeding of the sliver or top. Moreover, each yarn feeding device comprises a thread guide lying adjacent to the angular position of the needles, in order to feed yarn to the needles themselves.

The cylinder is provided with grooves, in which slide the needles which are driven in traverse by a series of cams and control organs, to stitch at least one thread presented by a set of feeders of the machine.

Further aims and advantages of the present invention will be clear from the following description and from the enclosed drawings, supplied purely as an explanatory example without limitation, in which.

Figure 10:
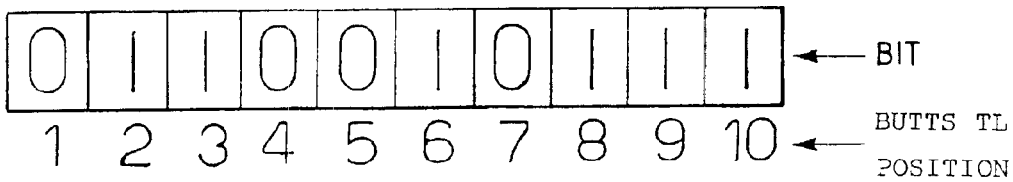
Figure 11:
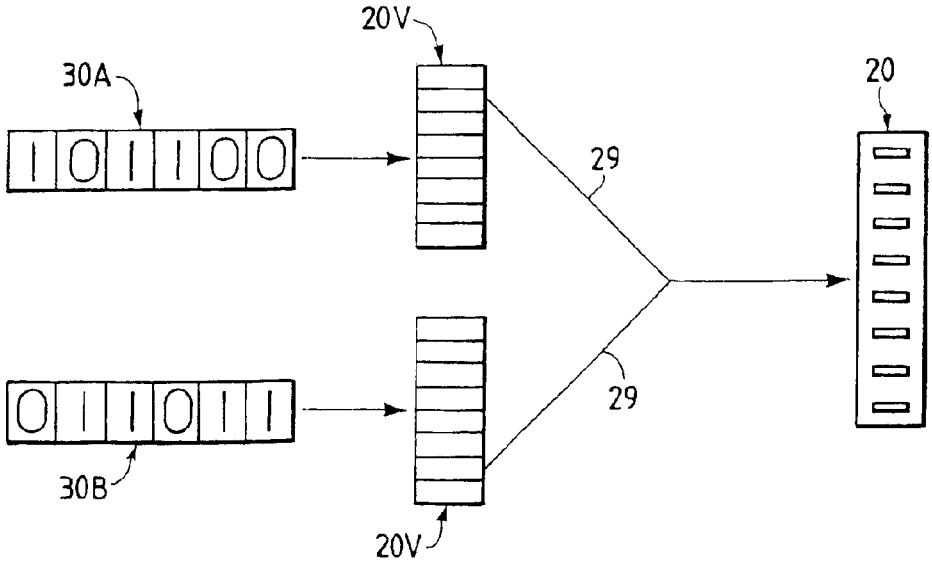

FIG. 10 schematically shows the set of a representative sequence of bits of a pattern to be realised on fabric with a textile machine, in particular a circular machine for knitwear, according to the invention;

FIG. 11 shows an operating diagram of the management software of the actuators of a circular machine for knitwear according to the present invention.

Figure 1:
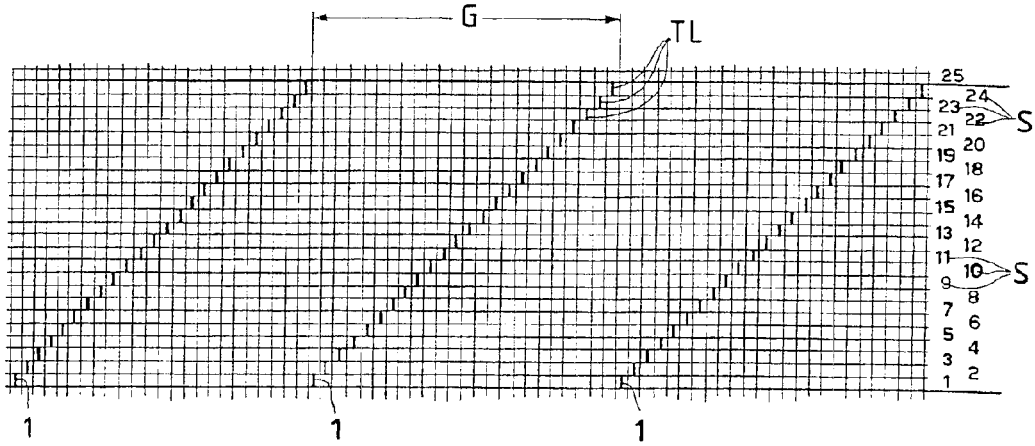
FIGS. 1 and 2 illustrate two examples of schematic arrangements of the butts of the needles of a circular machine for knitwear, depending on the selection levels contemplated for each needle.
Figure 2:
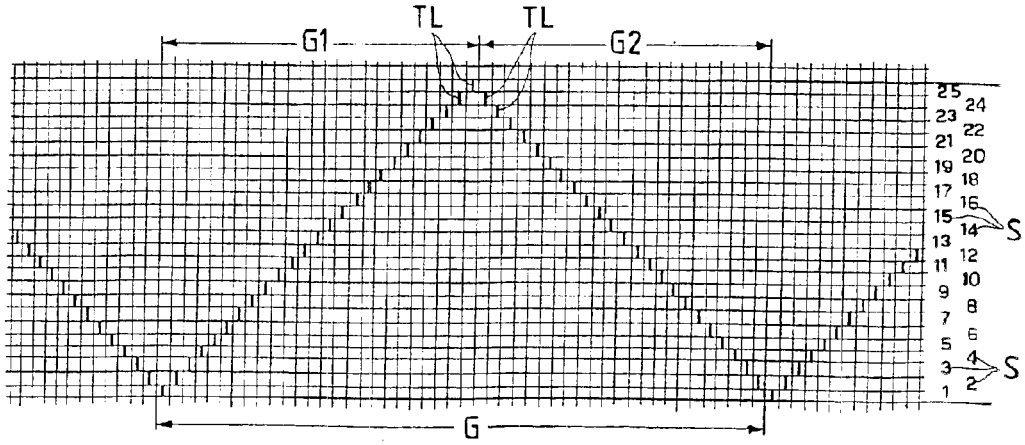
Figure 4:
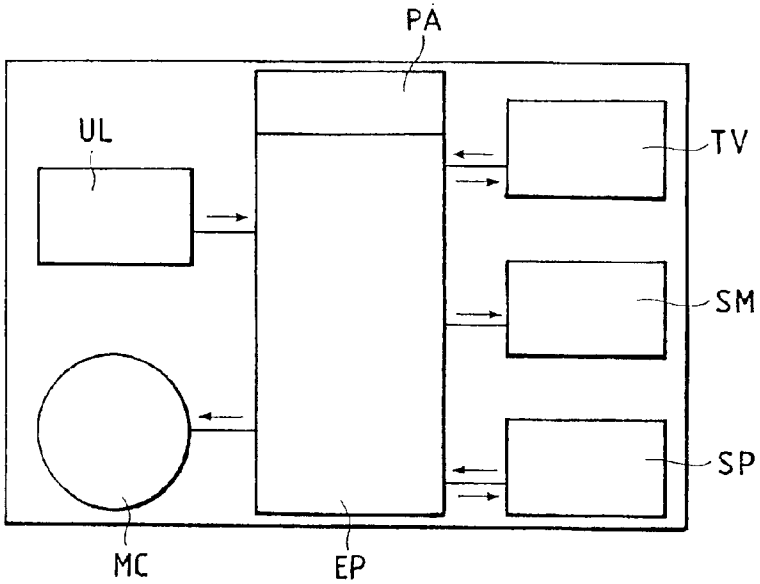
FIG. 4 is a block diagram of an electronic system for management of the group for selecting the needles in a circular machine for knitwear, according to the prior art.
Figure 3:
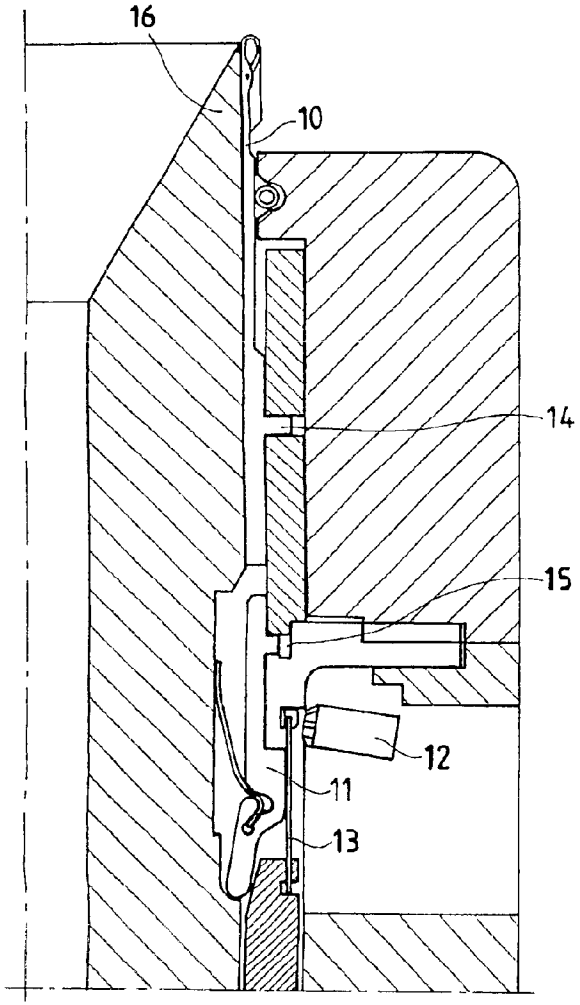
FIG. 3 is a partial and partly sectioned view of a first embodiment of an actuator used for the selection of the needles in a circular machine for knitwear, according to the prior art.
Figure 4A:
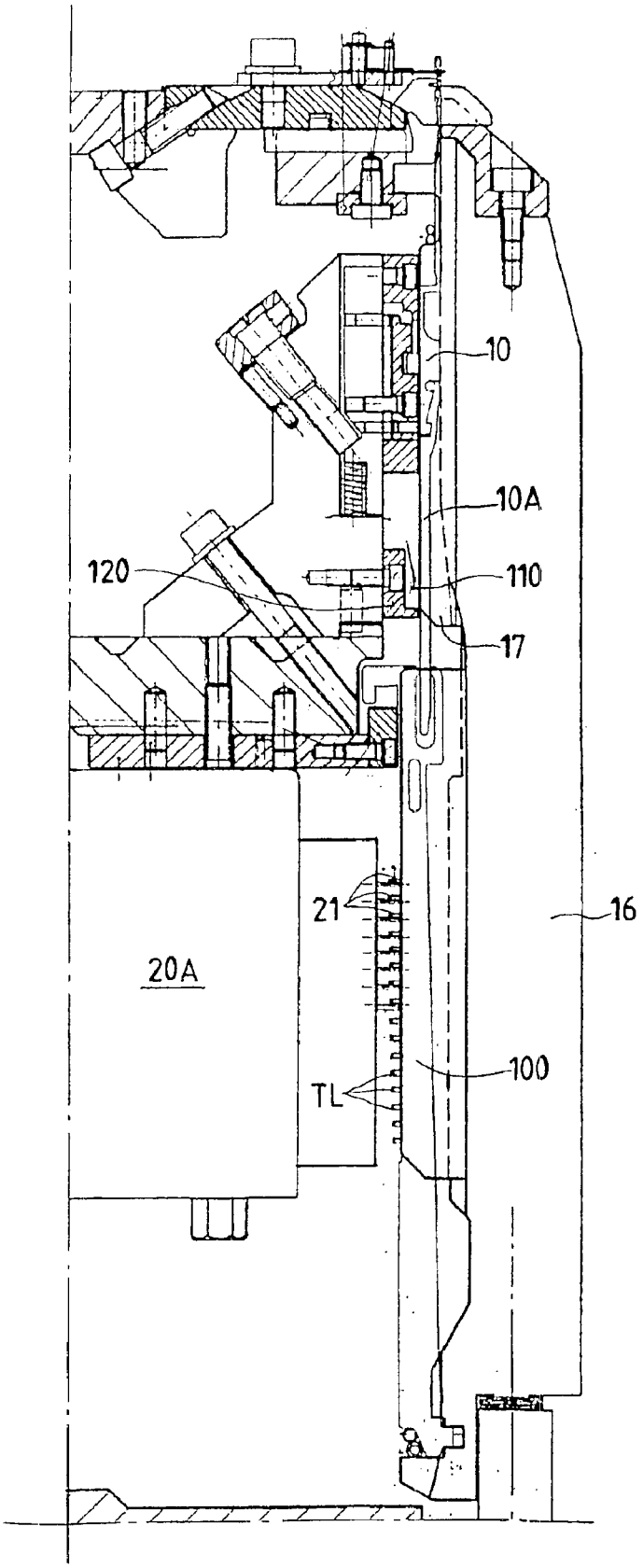
Fig.4A PRIOR ART
FIG. 4A is a partial and partly sectioned longitudinal view of a circular machine for knitwear in which an electronic needle selection system of a traditional type is used.
Figure 4B:
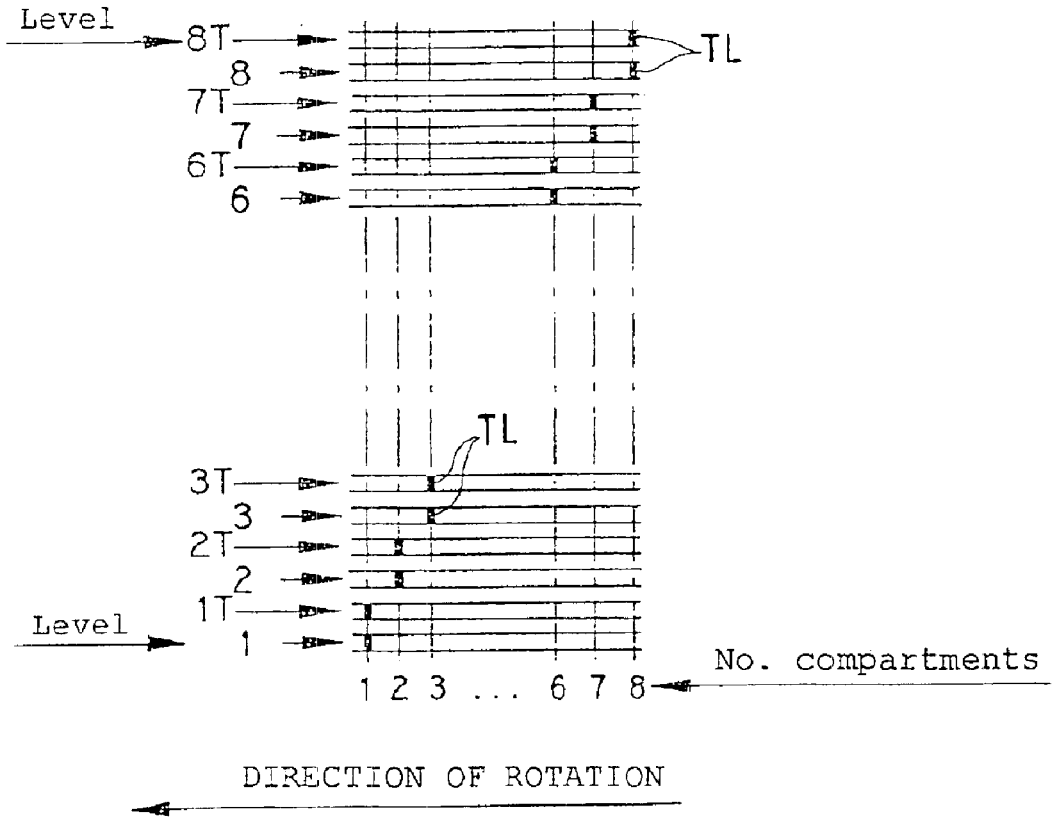
Fig.4B PRIOR ART
FIG. 4B represents the arrangement of the butts of the selectors in the circular machine for knitwear in FIG. 4A.
Figure 4C:
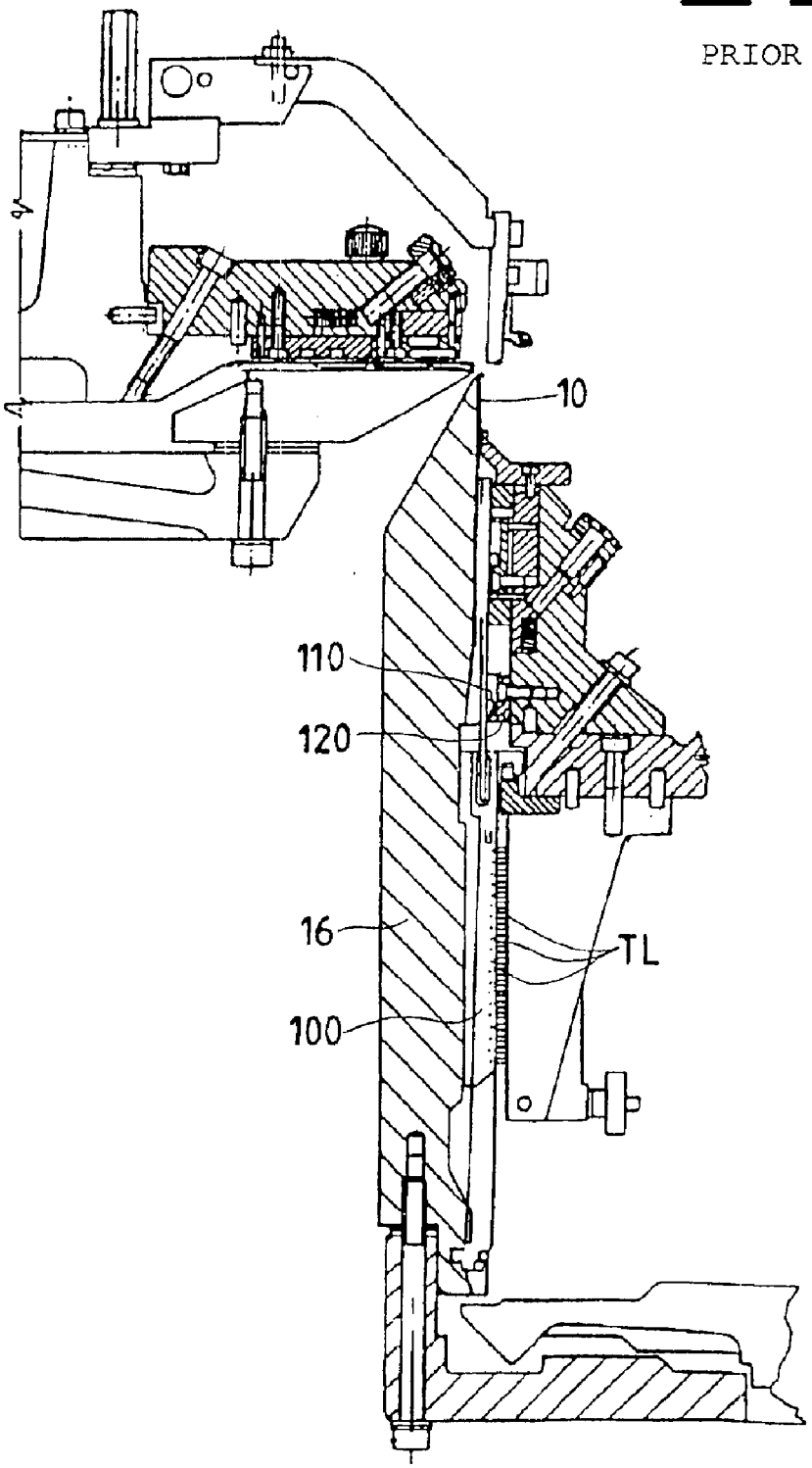
Fig.4C PRIOR ART
FIG. 4C is a partial and partly sectioned longitudinal view of a circular machine for knitwear with double set of needles which uses a mechanical system for selecting the needles and a traditional type of cylinder.
Figure 4D:
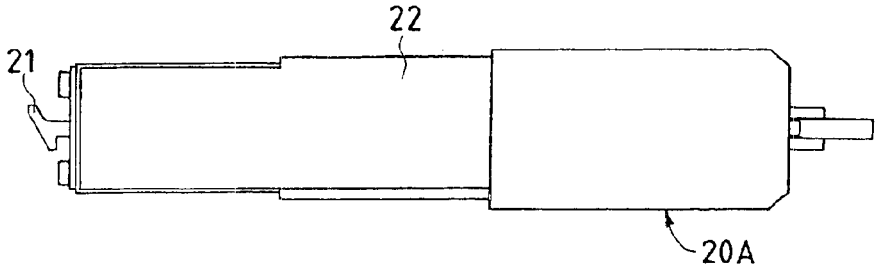
Fig.4D PRIOR ART
FIG. 4D is an overhead view of an embodiment of an electromechanical actuator according to the prior art.
Figure 4E:
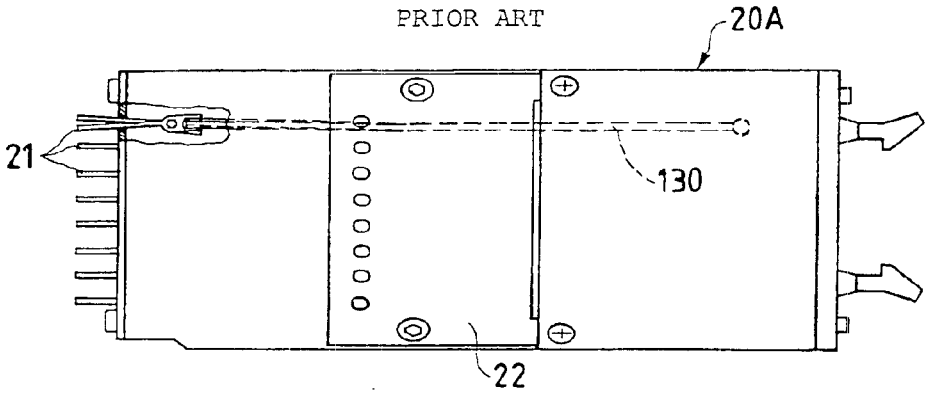
Fig.4E PRIOR ART
FIG. 4E is a front view of the actuator in FIG. 4D.
Figure 4F:
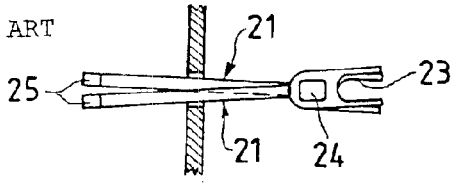
Fig.4F PRIOR ART
FIG. 4F is a side view of a lever of the actuator in FIG. 4E, mobile between two working positions.
Figure 4H:
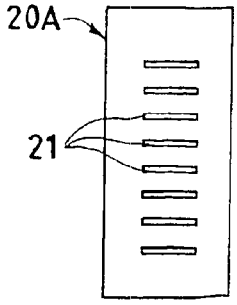
Fig.4H PRIOR ART
FIG. 4H is a side view of the actuator in FIG. 4E.
Figure 4G:
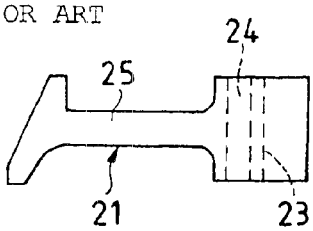
Fig.4G PRIOR ART
FIG. 4G represents a layout and enlarged view of the lever in FIG. 4F.
Figure 4L:
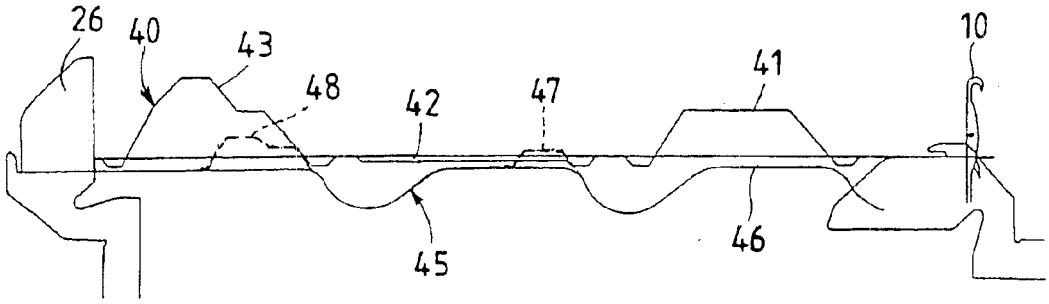
Fig.4L PRIOR ART
FIG. 4L represents the schematic path of the needles and of the sinkers with traditional selection among three technical ways.
Figure 4M:
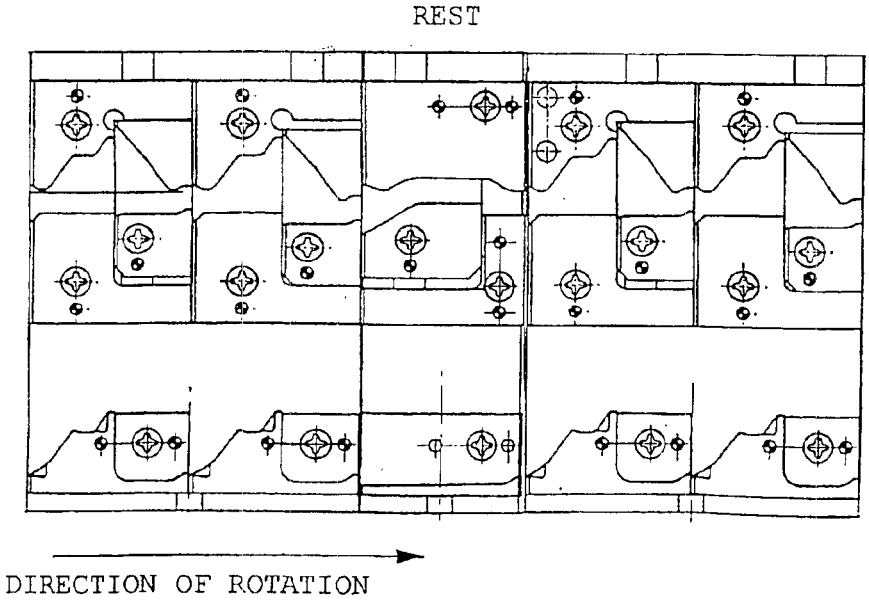
Fig.4M PRIOR ART
FIG. 4M represents the path of cams of the needles of the cylinder set up for traditional selection among three technical ways.
Figure 4N:
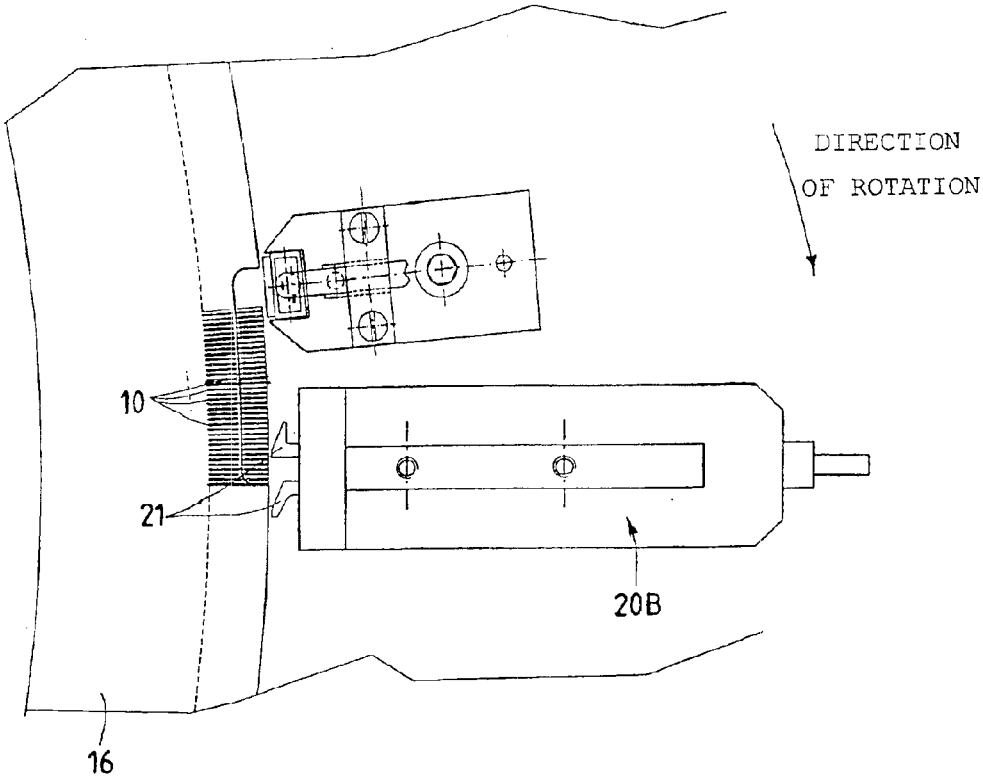
Fig.4N PRIOR ART
FIGS. 4N, 4P and 4Q represent, on three views, an electromechanical actuator according to the prior art for selection among three technical ways.
Figure 4P:
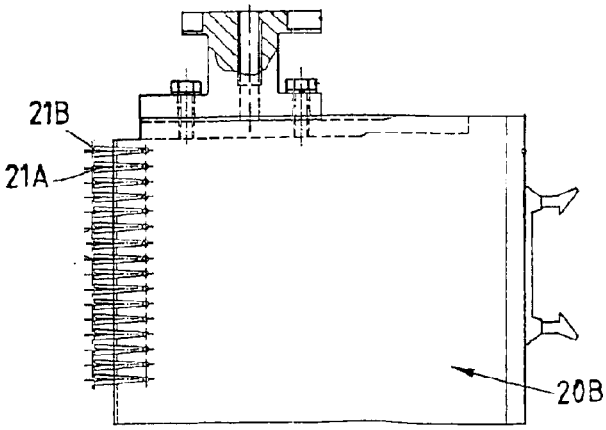
Fig.4P PRIOR ART
Figure 4Q:
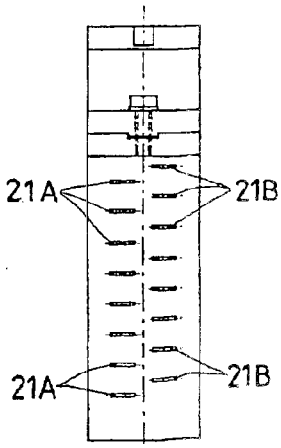
Fig.4Q PRIOR ART
Figure 5:
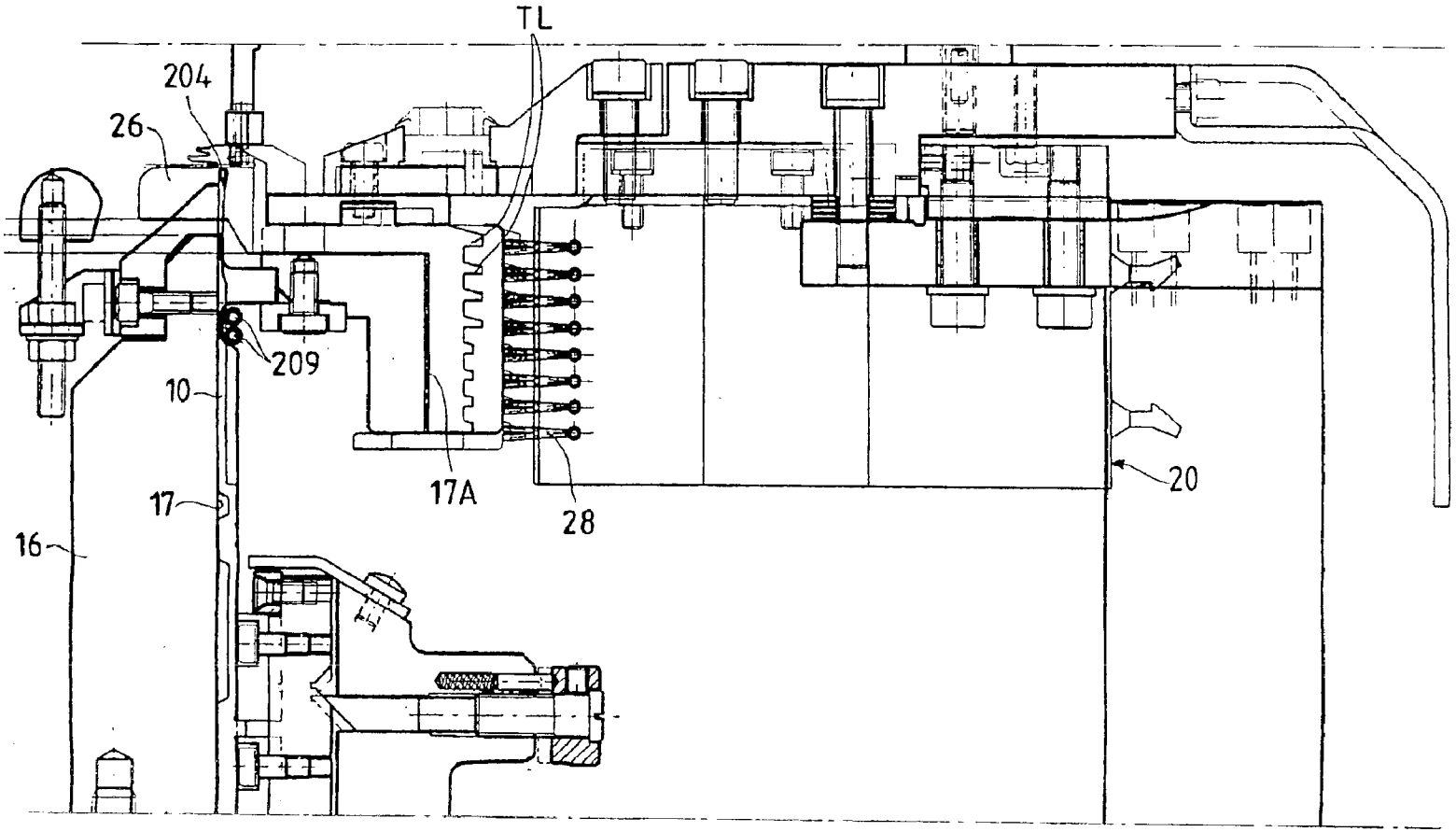
FIG. 5 is a partial and partly sectioned longitudinal view of a circular machine for knitwear in which a system for selecting the sinkers according to the present invention is used.
Figure 5A:
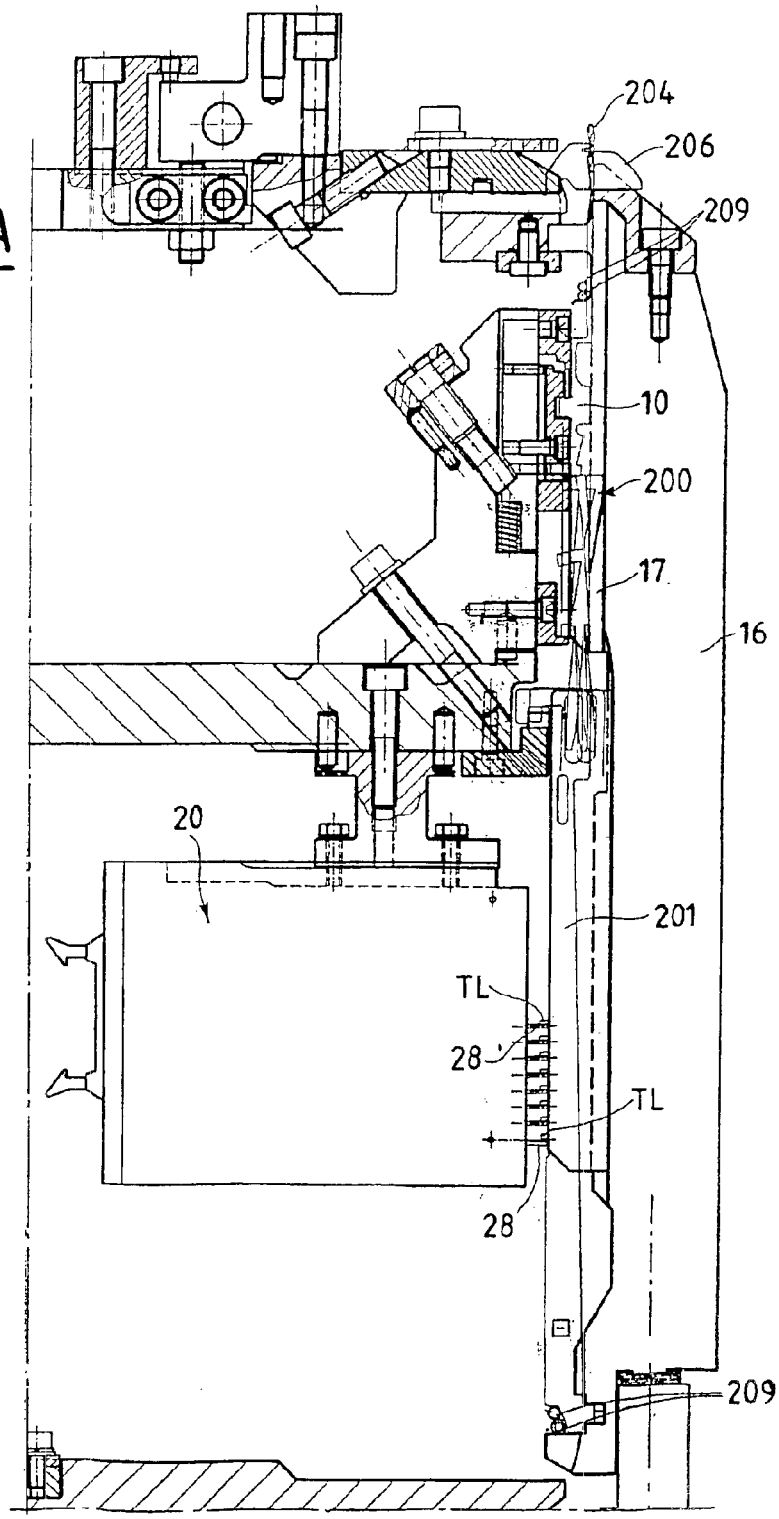
FIG. 5A is a partial and partly sectioned longitudinal view of a circular machine for knitwear in which a system for selecting the needles among three technical ways according to the invention is used.
Figure 5B:
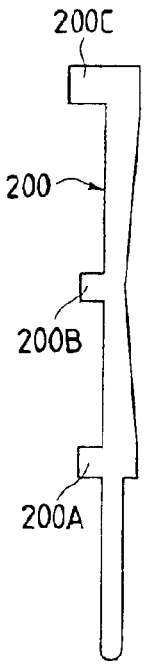
FIG. 5B shows an enlarged detail of FIG. 5A.

With particular reference to the above-mentioned FIG. 5, which illustrates a machine for terry cloth with electronic selection of the sinkers (the latter are indicated with 26 in FIG. 5), this machine presents a plurality of actuators 20, suited for selecting, for each needle 10, the corresponding sinker 26 and for directing it on three technical ways (here reference is also made to FIG. 4L, in which the path of the needles 10 is indicated with 40 and areas 41, 42, 43 are identified, corresponding to which the needles 10 are, respectively, loading, out of work, and working), in order to obtain areas of fabric without terry loops (first way, indicated generally with 46 on the path 45 of the sinkers), areas with short terry loops (second way, indicated with 47 in FIG. 4L) and areas with long terry loops (third way, indicated with 48).

Each sinker 26 is provided with a selecting butt TL, which can interact on the corresponding selecting lever 28 activated by the actuator 20.

Figure 6:
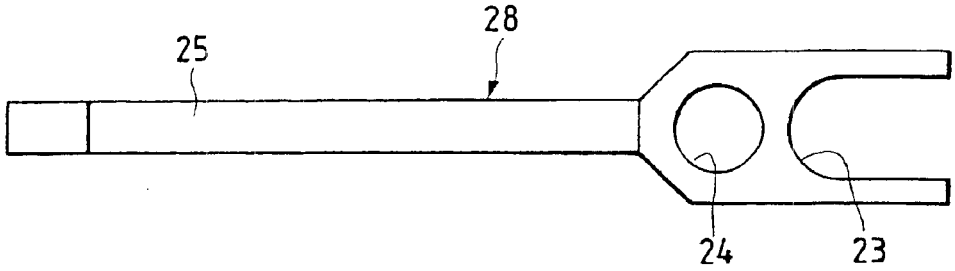
FIG. 6 is a side view of a lever realised according to the present invention and used in an actuator for selecting the stitch forming organs (needles and/or sinkers) in a circular machine for knitwear.
Figure 7:
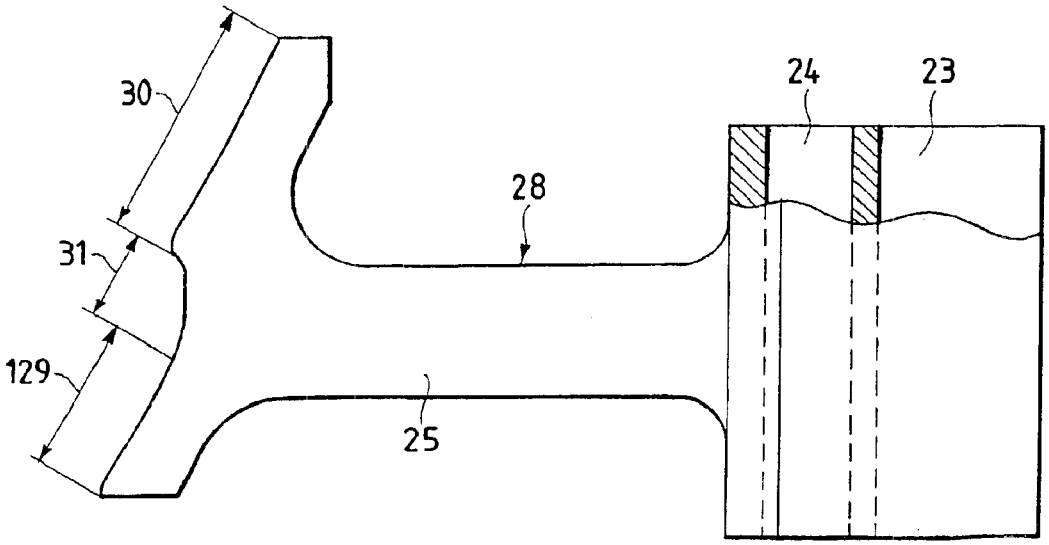
FIG. 7 is a layout view of the lever in FIG. 6, according to the present invention.

As may be clearly seen from FIGS. 6 and 7, according to the present invention, the lever of the actuator 20, indicated overall with 28, presents a shaped front end, the profile of which has at least two rising sections, indicated generally with 129 and with 30, connected by a portion of profile, indicated with 31, suited for producing disengagement of the end of the lever 28 from the selecting butt TL of the selector of each needle 10 or sinker 26.

In practice, in advance with respect to profiles 30 and 129, it is possible to perform, respectively, a first and a second selection of the considered needle 10, using a single lever, thus realising the intended aim of being able to give at least two commands (selection and operating mode) for each butt TL of each needle 10 or sinker 26.

If the lever 28 does not interact with the butt TL of the sinker 26, the corresponding needle 10 does not make any terry loop; on the contrary, if the lever 28 is activated by the actuator 20 and interacts, by effect of the rotation of the cylinder 16, on the butt TL for the duration of the ramp profile 30 and is then disengaged by the actuator 20 in the section 31, the needle 10 makes a short terry loop.

Finally, if the lever 28 is not disengaged, but is kept in contact with the butt TL even corresponding to the profile 129, the needle 10 will make a long terry loop.

With particular reference to FIGS 5A, 5B, 8 and 9, a circular machine for knitwear with multiple needle selection, according to the present invention, comprises a rotating cylinder 16, on which are provided a series of grooves 17; the needle 10 is free to move within each groove 17 and it can move in a vertical direction thanks to the movement of the the control elements comprising a jack 200, sliding in the groove 17, and a selector 201, housed in the same groove 17 and free to swing.

A first fixed cam 203 guides the needle 10 to slide in traverse within the groove 17, while the top of the needle 10 has a hook 204, suited for catching fibres of pile and/or a base thread and/or a thread for the terry loop and to loop it, with the adjustable stitching cams 205, in collaboration with the alternate movement of the sinkers 206. The jack 200 allows the needle 10 to be pushed upwards, striking against its foot, and it is guided in traverse along the groove 17 by a second cam with three paths 207, while the selector 201 presents a fork-shaped end to allow the insertion of a bottom end of the jack 200.

The jack 200 is provided with three butts 200A, 200B, 200 C; the butt 200A is a service butt and is used for bringing down the jack 200, following the profile 207A of the cam 207, if the jack 200 has previously been selected and raised.

If the jack 200 is selected by the lever 28, which is engaged on the respective butt TL of the selector 201, the butt 200B enters, protruding from the cylinder 16, in the path 207B, which takes the jack 200 and the respective needle 10 into the position to catch the new thread and to hold the previous stitch.

The butt TL interferes on the lever 28 only for the section 30, since, when the butt TL follows the profile 31, the lever 28 is disengaged by the command given by the management software.

In this condition the butt 200C remains inactive and sunk in the groove 17 of the cylinder 16.

If the jack 200 is selected by the lever 28, which engages on the respective butt TL of the selector 201, the butt 200C enters, protruding from the cylinder 16, in the path 207C, which takes the jack 200 and the respective needle 10 into the position to catch the new thread and to clear the previous stitch.

In this case the butt TL interferes on the lever 28 for both sections 30 and 129 and both the butts 200B and 200C are active, protruding from the groove 17 of the cylinder 16.

Around the cylinder 16 and enveloping the needle 10 and the corresponding selector 201, snap rings 209 are provided, which hold each needle 10 and selector 201 inside each groove 17 of the cylinder 16, so that they are not expelled from the grooves 17, due to the high centrifugal stress which occurs during operation.

In the specific case of circular machines for knitwear of the jacquard type, the needle 10 can perform three different paths or technical ways (four for the machines with pile), so that the hook 204 lifts to a different height to form different types of stitches. The choice of one of the three or four possible technical ways is made using actuating devices 20 which are a standard feature on each feeding station of the machine.

Figure 9:
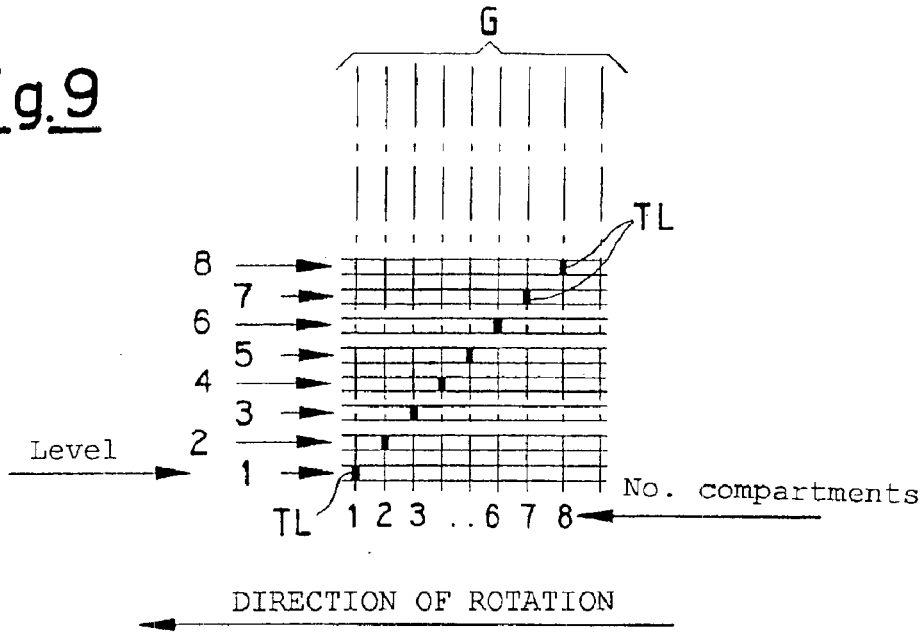
FIG. 9 represents the arrangement of the butts of the selectors or of the sinkers, according to the invention.
Figure 8:
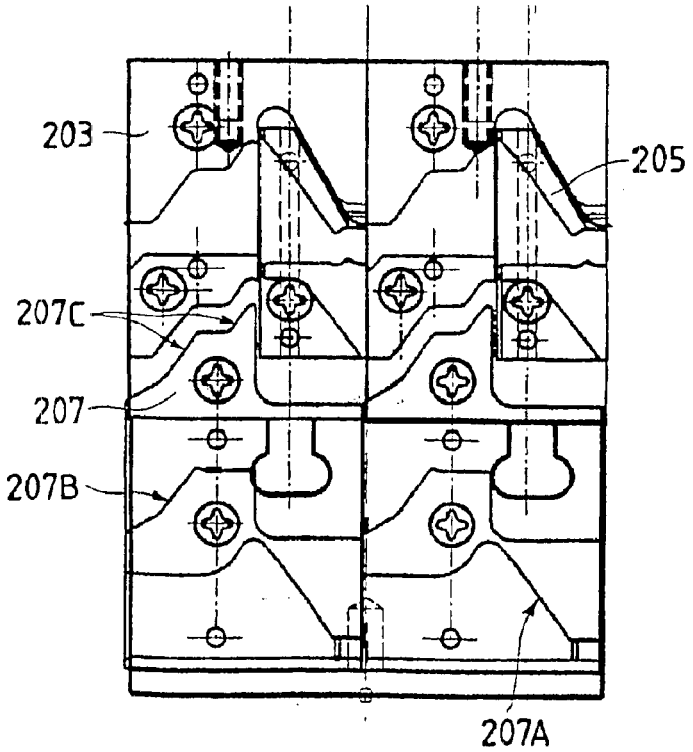
FIG. 8 shows a path among three technical ways according to the present invention.

The software for the electronic management of the needle selection system, according to the present invention, presents the peculiar characteristic of updating the status of the single lever of the actuator 20, not only in the standard activation phase, but-also in another position at a distance of a predetermined measurement and included between 1 and the number K of butts TL that make up a diagonal of the diagram in FIG. 9 and belonging to the group indicated with G in said figure. Usually, moreover, the number K of butts TL is the same as the number of levers of the actuator 20 and that is equal to 8.

The correct value of the measurement between 1 and K is determined by the profile of the lever of the actuator 20 which, as previously recalled, in the specific case of the present invention, assumes a particular and preferred configuration, as illustrated in detail in FIGS. 6 and 7.

The information in bits read by the management software for establishing the status of the lever in the predetermined position and between 1 and K may normally be taken from the pattern that is to be reproduced on the fabric; moreover this status may be coded in different ways.

In particular, considering a series of needles that may be selected by means of the lever-butt mechanism, according to which the selection elements have a butt in a different position for the needle in position M and a needle in position M+1 to a needle in position M+K, realising a diagonal of K butts TL, in which K is equal to the number of levers 28 of the actuator 20 and following the example in which the needle M has the butt TL in position 1 and K is equal to 8, the management software of the system according to the invention may update the status of the lever 28, in such a way that it is activated with sufficient advance (anyway less than 8 needles) to make it intercept or not (depending on the value of the corresponding bit in the sequence for the pattern to be realised on the fabric) with the butt TL of the needle M.

In the case described, the software updates the status of the lever 28 in a standard angular position equal to M+advance and, subsequently, to the positions M+X+advance, M+K+advance, M+X+K+advance, M+2K+advance, M+X+2K+advance, etc., in which X (measurement between 1 and K) represents the second predetermined position of updating of the status of the single lever 28 of the actuator 20, as well as the position corresponding to a standard phase.

Considering, for example, X=4, it is found that for the needle M+4 the electronic management software is able to update both the lever 28 placed in an initial reference position (1) in the actuator 20 and the lever 28 placed in a position corresponding to (1)+4=(5).

It is thus possible to update, at each movement of the rotating cylinder 16 of 1 needle, 2 or more levers 28 of the actuator 20, depending on the information contained in the pattern.

Note that, in the prior art, the management software is able to recognise, for each actuator 20, the respective phase with the cylinder 16 ("actuator phase"), so as to recognise, depending on the position of the cylinder 1, the correct lever 28 to be activated; moreover, the software must recognise the arrangement of the butts TL of the various selectors, always with respect to the angular position of the cylinder 16 ("cylinder zero"). Besides, according to the present invention, the application software realised is able to recognise, for each actuator 20, at least two respective phase parameters with respect to the cylinder 16, in order to establish for each angular position which levers 28 must be updated on the same needle 10; in other words, it is possible to set the control software in order to manage at logic level two actuators 20 for each feeding station, with respective phase less than K, which physically activate the same outputs of the same actuator 20.

For example, it is possible to realise a management software which allows the control of two virtual actuators 20V on the same feeding station (see for example FIG. 11); each of the two virtual logic actuators 20V is able to update the status on a single lever 28 at each movement of the cylinder 16 equal to the angular rotation between one needle and the next, as in the traditional application programmes; however, each one of the two virtual actuators 20V transfers the status of the logic outputs on the same physical outputs 29 of the same actuator, so that, in fact, the updating of the status of the two levers 28 on the same needle 10 is obtained.

In this way, selection systems with several technical ways (represented in the example in FIG. 11 by the sequence of bits of the pattern to be represented, which are generally indicated with 30A (first technical way) and 30B (second technical way)) which are realised with distinct physical actuators may be realised with application software which manages the same number of logic actuators 20V, which, however, controls only one physical actuator 20, with evident resulting saving in energy, production and running costs.

From the description given the characteristics of the needle selection system for textile machines, to which the present invention refers, may be clearly understood, just as its advantages are clear.

Finally it is clear that numerous modifications and variations may be made to said selection system, without departing from the principals of novelty inherent in the inventive idea, just as it is clear that, in the practical application of the invention, the materials, forms and dimensions of the details illustrated may be any ones depending on necessities and they may be replaced with others that are technically equivalent to them.

What is claimed is:

1. System for selecting the stitch forming elements for textile machines for knitwear, comprising at least one actuator (20), suited for commanding the selection and operation, by means of contact levers (28), on at least one butt (TL) provided on selectors, jacks or sinkers (26), said stitch forming organs being moved in such as way as to obtain a predefined pattern on the fabric, wherein said system further includes an electronic management device comprising a softwear program set in such a way as to update the status of each lever (28) of the actuator (20), in first predetermined time intervals corresponding to first angular positions that elapse between a first preset number of stitch forming organs, and also in second predetermined time intervals corresponding to second intermediate angular positions and included between 1 and said first preset number of stitch forming elements, said first number of elements being equal to the number of the levers (28) in line with said actuator (20).

2. Selection system as in claim 1, wherein said angular positions are determined by each lever (28) of the actuator (20).

3. Selection system as in claim 1, wherein said selection system can be used in circular or rectilinear machines for knitwear or hosiery, said machines comprising at least one rotating cylinder on which are provided a series of first grooves (17) on which needles (10) are free to slide in a vertical direction due to the movement of the command elements.

4. Selection system as in claim 1, wherein said selection system can be used in circular or rectilinear machines for knitwear or hosiery with selection sinkers (26), said sinkers (26) being free to slide inside a second groove (17A).

5. election system as in claim 1, wherein said actuator device (20) allows engaged movement of at least one of said levers (28), in order to direct needles (10) or groups (G, G1, G2) of needles (10) into a predetermined position, said needles (10) being selected for the production of different types of stitches and being moved in such a way that some of said needles may be lifted higher than others to catch one or more threads to clear or to retain said threads.

6. Selection system as in claim 1, wherein said actuator device (2) allows engaged movement of at least one of said levers (28), so as to direct sinkers (26) or groups (G, G1, G2) of sinkers (26) into into a predetermined position, said sinkers (26) being selected for the production of different types of terry fabrics, with long or low loops or without loops in order to obtain patterned effects on the fabric.

7. Selection system as in claim 1, wherein each of said levers (28) of the actuator (20) presents a shaped front end, the profile of which has at least two rising sections (30, 129), connected by at least one portion of profile (31) suited for producing the disengagement of said end of lever (28) from butt (TL) of each selector of said stitch forming elements.

8. Selection system as in claim 7, wherein at least two selections of said butt (TL) corresponding to rising sections (30,129) may be activated by using a single lever (28), in order to give at least two commands, regarding selection and operating mode, for each butt (TL) of each stitch forming element.

9. Selection system as in claim 1, wherein said actuators (20) are able to select, for each needle (10) of a machine for terry with electronic selection of the sinkers (26), at least one corresponding sinker (26) and to direct it into a plurality, sinkers in order to obtain areas of fabric without terry loops (46), areas with short terry loops (47) and areas with long loops (48), each of said sinkers (26) being provided with said selection butt (TL), suited for interacting on at least one corresponding selection lever (28) operated by said actuator (20).

10. Selection system as in claim 3, wherein said needles (10) are free to travel in a vertical direction inside said grooves (17), due to the movement of command, elements comprising at least one jack (200), sliding inside said groove (17), and at least one selector (201), housed in the groove (17) and free to swing, each of said needles (10) being guided to slide in vertical movement in the groove (17) by at least one first fixed cam (203), while the to p of each needle (10) has a hook (204) adapted for catching fibers of pile or a background thread and/or a thread for the terry loop, and to loop said thread, by means of adjustable stitching cams (205) and sinkers (206), said jack (200) being guided in traverse along the groove (17) by a second cam (207) and said selector (201) presenting at least one shaped end to allow the insertion of a bottom end of the jack (200).

11. Selection system as in claim 10, wherein said jack (200) is provided with a plurality of butts (200A, 200B, 200C), of which a first butt (200A) is a service butt used for bringing down the jack (200), if the jack (200) has previously been selected and raised, a second butt (200B), if the jack (200) is selected, enters, protruding from the cylinder (16), in a first path (207B) of said second cam (207), which takes the jack (200) and the respective needle (10) into the position to catch the new thread and to hold the previous stitch, said butt interfering on said selection lever (28) only for a first section (30) of the same, and a third butt (200C), if the jack (200) has been selected by said selection lever (28), which engages in a respective but (TL) of said selector (201) for at least two sections (30, 129) of the selection lever (28), enters a second path (207C) of said second cam (207), which takes the jack (200) and the respective needle (10) into the position to catch the new thread and to clear the previous stitch.

12. Selection system as in claim 1, wherein said softwear program allows a series of information in bits to be read directly from the pattern that is to be reproduced on the fabric to establish the status of said lever (28) in a predetermined position included between 1 and said first preset number of stitch forming elements.

13. Selection system as in claim 12, wherein, in the case in which said butts (TL) are in a diagonal arrangement and have a different position from a first to a second selector, said softwear program is able to update the status of said lever (28), in such a way that it is activated with a sufficient advance value to cause said lever (28) to interfere or not with the butt (TL) of said selector.

14. Selection system as in claim 13, wherein said softwear program updates the status of the lever (28) in a standard angular position equal to the position of said selector, to which is added said advance value and, subsequently, in angular positions equal to the position of said selector, to which are added, in numerical sequence, the total number of selectors present in each group (G, G1, G2), said advance value and at least one of said second intermediate angular positions.

15. Selection system as in claim 3, wherein said softwear program allows the updating, at each movement of said rotating cylinder (16) equal to the position of at least one of said stitch forming elements, of at least two of said levers (28) of the actuator (20).

16. Selection system as in claim 15, wherein said softwear program is able to recognize, for each actuator (20), at least two relative phase parameters with respect to said cylinder (16), in order to establish, for each angular position, the levers (28) of the actuator (20) to be updated on a single stitch forming element.

17. Selection system as in claim 16, wherein said softwear program can be set in such a way as to manage at logic level at least two logic actuators (20V) for each feeding station of the machine, said logic actuators (20V) having a relative phase lower than the number of stitch forming elements present in each group (G, G1, G2) and being suited for physically activating the outlets of one same actuator (20).

18. Selection system as in claim 17, wherein said softwear program is able to control at least two logic actuators (20V) on one same feeding station, said logic actuators (20V) being able to update the status of one of said levers (28) at each movement of said cylinder (16) equal to the angular rotation between one stitch forming element and the next.

19. Selection system as in claim 18, wherein each of said logic actuators (20V) transfers the status of the logic outputs on the same physical outlets (29) of a same actuator (20), so that, the updating of the status of at least two levers (28) of the actuator (20) on a same stitch forming element is obtained.

* * * * *